US010788217B2

(12) United States Patent
Pianezze

(10) Patent No.: US 10,788,217 B2
(45) Date of Patent: Sep. 29, 2020

(54) LIGHTING CONTROL SWITCH HARNESS FOR GAS TAPS WITH OPTICAL INDICATION OF OPENING OF THE GAS TAP, FOR COOKING APPLIANCES

(75) Inventor: Daniele Pianezze, Cassano Magnago (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 2426 days.

(21) Appl. No.: 13/510,688

(22) PCT Filed: Dec. 20, 2010

(86) PCT No.: PCT/US2010/061216

§ 371 (c)(1),
(2), (4) Date: Jun. 1, 2012

(87) PCT Pub. No.: WO2011/084729

PCT Pub. Date: Jul. 14, 2011

(65) Prior Publication Data

US 2012/0247452 A1 Oct. 4, 2012

(30) Foreign Application Priority Data

Dec. 21, 2009 (IT) ..... TO2009A1012

(51) Int. Cl.
*F24C 3/10* (2006.01)
*H01H 19/62* (2006.01)
*H01H 3/02* (2006.01)

(52) U.S. Cl.
CPC ..... *F24C 3/103* (2013.01); *H01H 3/0206* (2013.01); *H01H 19/62* (2013.01)

(58) Field of Classification Search
CPC ..... G05D 23/19; H01H 3/0206
(Continued)

(56) References Cited

U.S. PATENT DOCUMENTS 124,126 A * 2/1872 Gardiner, Jr. ..... F23Q 7/22 200/4
1,728,015 A * 9/1929 Spoehrer ..... F16K 31/048 185/41 R (Continued)

FOREIGN PATENT DOCUMENTS

DE 19823120 A1 * 11/1999 ..... F24C 3/124
EP 1500881 A2 1/2005

(Continued)

OTHER PUBLICATIONS

Italian Search Report for Application No. TO20091012 dated Aug. 19, 2010.

(Continued)

*Primary Examiner* — Edelmira Bosques
*Assistant Examiner* — Logan P Jones
(74) *Attorney, Agent, or Firm* — Pilloff Passino & Cosenza LLP; Martin J. Cosenza

(57) ABSTRACT

A lighting control switch harness includes a plurality of elements each including a body for a respective gas tap, one or more light sources, and a printed circuit. A first switch includes a first member couplable to a mobile stem of the gas tap for integrally rotating therewith and taking contacts of the first switch towards one another. A second switch includes a second member couplable to the stem of the tap for translating parallelly thereto and taking contacts of the second switch towards one another. The elements are connected to one another only by a first wire connected to a first contact of the second switch of each element, a second wire connected to a second contact of the first switch of each element, and a third wire connected to a second contact of the second switch of each element and to the printed circuit.

21 Claims, 3 Drawing Sheets

(58) Field of Classification Search
USPC ..... 431/13, 14; 200/569; 362/23.04, 84; 126/39 N, 39 E, 39 BA
See application file for complete search history.

(56) References Cited

U.S. PATENT DOCUMENTS 1,735,834 A * 11/1929 Mayo ..... F23Q 7/10 431/256
1,929,455 A * 10/1933 Smith ..... G05D 7/00 137/624.11
1,949,538 A * 3/1934 Floraday ..... F21L 4/00 200/4
1,996,416 A * 4/1935 Haines ..... B60Q 1/1484 200/1 A
2,037,148 A * 4/1936 Reeves ..... F24C 3/103 200/6 BB
2,146,660 A * 2/1939 Swartz ..... F24C 3/103 431/256
2,276,751 A * 3/1942 Weber ..... F24C 3/103 200/61.86
2,596,505 A * 5/1952 Pacifico ..... F24C 3/10 200/61.86
2,614,199 A * 10/1952 Fallon ..... F24C 7/087 219/487
2,667,605 A * 1/1954 Massier ..... F23Q 11/06 431/191
2,813,176 A * 11/1957 Miller ..... H01H 89/04 200/4
2,910,874 A * 11/1959 Jonassen ..... G05G 7/02 116/253
3,040,155 A * 6/1962 Tyler ..... G04C 23/16 219/412
3,114,824 A * 12/1963 Detterbeck ..... F24C 7/082 116/286
3,436,165 A * 4/1969 Gehrke ..... F16K 5/0214 361/253
3,499,125 A * 3/1970 Stoi ..... B60Q 1/1476 200/4
3,502,835 A * 3/1970 Batcheller ..... H01H 1/18 200/469
3,529,584 A * 9/1970 Celaya ..... F24C 3/124 126/39 N
3,860,786 A * 1/1975 Wass ..... F25B 49/04 200/61.86
3,971,904 A * 7/1976 Ward ..... F24C 3/103 200/303
3,983,348 A * 9/1976 Kellogg ..... G05G 1/105 200/313
4,002,866 A * 1/1977 Ward ..... H01H 3/0206 200/453
4,002,872 A * 1/1977 Desio ..... F24H 9/2035 200/293
4,019,855 A * 4/1977 Camillo ..... H01H 3/0206 126/39 E
4,103,132 A * 7/1978 Schwarzkopf ..... H01H 19/62 200/241
4,123,633 A * 10/1978 Stevens ..... H01H 19/62 200/61.86
4,249,047 A * 2/1981 Huff ..... H01H 3/0206 200/293
4,342,886 A * 8/1982 Demi ..... H01H 3/0206 200/61.86
4,358,647 A * 11/1982 Demi ..... H01H 3/0206 200/61.86
4,371,764 A * 2/1983 Runion ..... H01H 3/0206 200/61.86
4,730,090 A * 3/1988 Raab ..... H01H 3/0206 200/11 J
4,843,198 A * 6/1989 Lichtenberger ..... H01H 3/0206 200/293
5,017,745 A * 5/1991 Lichtenberger ..... H01H 3/0206 200/307
5,180,050 A * 1/1993 Rada ..... H01H 25/06 200/11 R
5,525,771 A * 6/1996 Lund ..... H01H 3/0206 200/61.86
5,542,449 A * 8/1996 Huang ..... G01K 1/14 137/163
5,545,034 A * 8/1996 Le Monnier De Gouville ..... F24C 3/103 431/255
5,583,327 A * 12/1996 Black, III ..... B60H 1/0065 137/560
5,682,979 A * 11/1997 Krueger ..... H01H 3/0206 200/571
5,687,836 A * 11/1997 Gjerde ..... H01H 1/5844 200/246
5,771,878 A * 6/1998 Lewis ..... G05G 1/02 126/42
6,079,401 A * 6/2000 Alvord ..... F24C 3/128 126/39 BA
6,096,987 A * 8/2000 Krueger ..... F24C 3/126 200/6 BB
6,420,667 B1 * 7/2002 Miwa ..... H01H 25/065 200/11 R
6,520,658 B2 * 2/2003 Chen ..... F21V 33/0004 362/101
6,541,721 B1 * 4/2003 Lamberti ..... H01H 3/0206 200/506
6,627,828 B1 * 9/2003 McCartney ..... F24C 3/124 200/61.86
6,646,214 B1 * 11/2003 Home ..... H01H 3/0206 200/61.86
6,733,146 B1 * 5/2004 Vastano ..... G05G 1/105 362/23.02
7,148,440 B2 * 12/2006 Gjerde ..... H01H 19/06 200/568
7,171,727 B2 * 2/2007 Wylie ..... F24C 7/082 16/441
7,425,128 B2 * 9/2008 Gjerde ..... F24C 3/126 335/162
7,525,051 B2 * 4/2009 Fukuda ..... B60H 1/0065 200/18
7,902,476 B2 * 3/2011 Querejeta Andueza ..... F24C 3/103 200/569
7,926,964 B2 * 4/2011 Claprood ..... G05G 1/105 362/23.01
8,173,924 B2 * 5/2012 Tegel ..... H01H 1/585 200/564
2005/0045172 A1 * 3/2005 Pianezze ..... F24C 3/103 126/39 BA
2005/0067268 A1 * 3/2005 Hurrle ..... H01H 19/025 200/314
2005/0145468 A1 7/2005 Kim
2006/0042925 A1 * 3/2006 Gjerde ..... H01H 19/06 200/569
2007/0187215 A1 * 8/2007 Lavigne ..... H01H 3/20 200/4
2009/0000930 A1 * 1/2009 Adams ..... H01H 25/065 200/316
2009/0207590 A1 * 8/2009 Tsung ..... G05G 1/105 362/100
2009/0277761 A1 * 11/2009 Huang ..... H01H 19/06 200/1 R
2009/0321231 A1 * 12/2009 Tegel ..... H01H 1/585 200/16 D
2010/0035195 A1 * 2/2010 Querejeta Andueza ..... F24C 3/103 431/256
2010/0216080 A1 * 8/2010 Home ..... F24C 3/126 431/13
2011/0100353 A1 * 5/2011 Rauth ..... H03K 17/96 126/39 BA
2011/0146650 A1 * 6/2011 Karamatic ..... F24C 7/082 126/42
2012/0171343 A1 * 7/2012 Cadima ..... A23L 1/0128 426/520

(56) References Cited

U.S. PATENT DOCUMENTS

| | | | | |
|---|---|---|---|---|
| 2012/0243253 | A1* | 9/2012 | Claprood | F24C 7/082<br>362/555 |
| 2012/0273705 | A1* | 11/2012 | Querejeta Andueza | F16K 31/0644<br>251/129.15 |
| 2014/0162200 | A1* | 6/2014 | Gerenabarrena | F24C 3/103<br>431/256 |
| 2014/0165849 | A1* | 6/2014 | Mateos Martin | A47J 36/32<br>99/342 |
| 2015/0059733 | A1* | 3/2015 | Herzog | F24C 3/10<br>126/39 E |

FOREIGN PATENT DOCUMENTS

| | | | |
|---|---|---|---|
| EP | 1511050 | A2 | 3/2005 |
| FR | 2418910 | A1 | 9/1979 |
| WO | 0102776 | A1 | 1/2001 |
| WO | 2008002863 | A2 | 1/2008 |

OTHER PUBLICATIONS

International Search Report and Written Opinion for PCT/US2010/061216 dated Apr. 13, 2011.

* cited by examiner

LIGHTING CONTROL SWITCH HARNESS FOR GAS TAPS WITH OPTICAL INDICATION OF OPENING OF THE GAS TAP, FOR COOKING APPLIANCES

RELATED APPLICATIONS

The present application is a national phase of PCT/US2010/061216, filed Dec. 20, 2010 and is based on, and claims priority from, Italian Application Number TO2009A001012, filed Dec. 21, 2009.

TECHNICAL FIELD

The present invention relates to a control switch harness for the lighting of burners of a cooking range, couplable in use to the gas taps feeding the burners and provided with an optical light indication when the gas tap is open.

BACKGROUND ART

It is known that control devices for the burners of a cooking range (either of the fitted type, or of the type belonging to a combined household appliance, e.g. comprising one or more oven cavities and/or a dishwasher) may comprise, for each burner, a gas tap and a switch harness element provided with a microswitch, the actuation of which supplies voltage to a service lighter circuit of the cooking range, of known type, which produces a sequence of sparks at one or all burners.

Generally, the gas tap is provided with an axially moveable, rotary control shaft or stem, provided in use with a control knob, the rotation of which allows the dispensing of combustible gas to the burner.

In the device known from EP1194720B1, the axial movement of the stem/knob assembly is used to actuate the microswitch, thus producing the generation of the lighting spark at the same time of the gas delivery.

If an optical indication of the gas tap opening is required, a supplementary device must be provided, e.g. equipped with LED, to be coupled to a gas tap.

Electricity is supplied to each module by means of appropriate wiring. This makes the wiring very complex and costly and weighs on assembly operations and time.

DISCLOSURE OF INVENTION

It is an object of the present invention to overcome such drawbacks by providing a lighting control switch harness for burners of a cooking range couplable to the burner feeding gas taps and provided with an optical light indication that gas tap is open, the construction and wiring of which is simple and reliable, and which is compact and relatively cost-effective.

The present invention thus relates to a lighting control switch harness for the burners of a cooking range, as disclosed in claim 1.

In particular, the lighting control switch harness of the invention comprises a plurality of elements connected to one another and each comprising a body couplable in use to a respective gas tap and closed by a cover at least partially pervious to light and a printed circuit underneath the cover and carrying one or more light sources, e.g. LEDs.

According to a feature of the invention, each switch harness element further comprises a first switch accommodated within the body and comprising at least one fixed contact connected to the printed circuit, a mobile contact and first means carried by the body so as to be operatively couplable in use to a mobile stem of the gas tap for integrally rotating therewith and consequently taking the mobile contact towards the at least one fixed contact; and a second switch accommodated within the body and comprising a fixed contact, a mobile contact and second means carried by the body so as to be in use operatively couplable to the mobile stem of the gas tap for translating parallelly thereto and consequently taking the mobile contact towards the fixed contact.

The elements of the switch harness are mechanically and electrically connected to one another only by means of three wires passing through the body of the various elements, a first wire being connected to a first contact of the second switch of each element, a second wire being connected to the mobile contact of the first switch of each element, and a third wire being connected to a second contact of the second switch of each element, while the printed circuit of each element is further electrically connected to the first wire.

In this manner, by using only three connection wires, two microswitches acting on two different circuits can be incorporated in a single switch harness element, one on the service lighting circuit of the cooking range and the other on the feeding circuit of the light sources, which provide the desired optical indication that the gas tap is open, which is obtained on the printed circuit.

BRIEF DESCRIPTION OF THE DRAWINGS

Further features and advantages of the present invention will be apparent from the following description of a preferred embodiment, exclusively provided by way of non-limitative example, with reference to the accompanying drawings, in which.

BEST MODE FOR CARRYING OUT THE INVENTION

Figure 3:
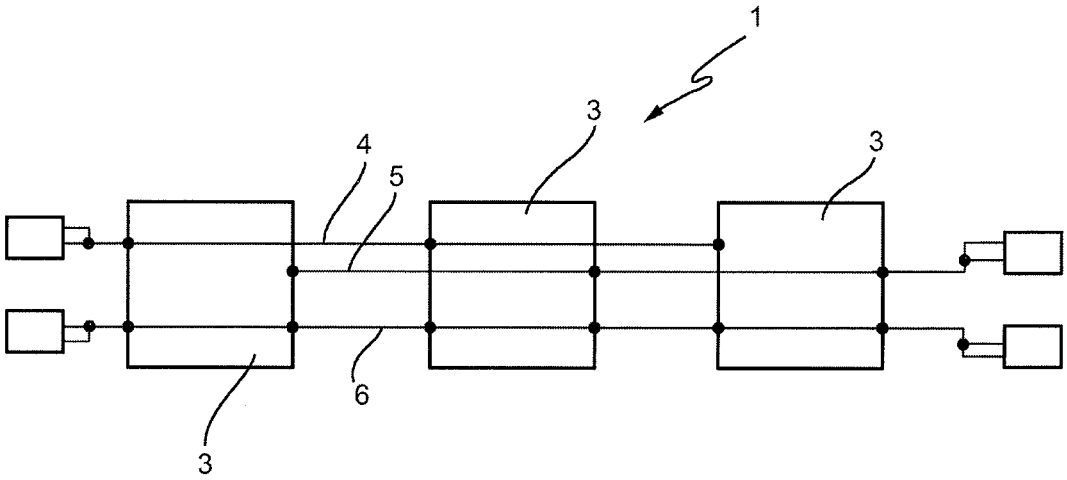
FIG. 3 diagrammatically shows the lighting harness according to the invention.
Figure 2:
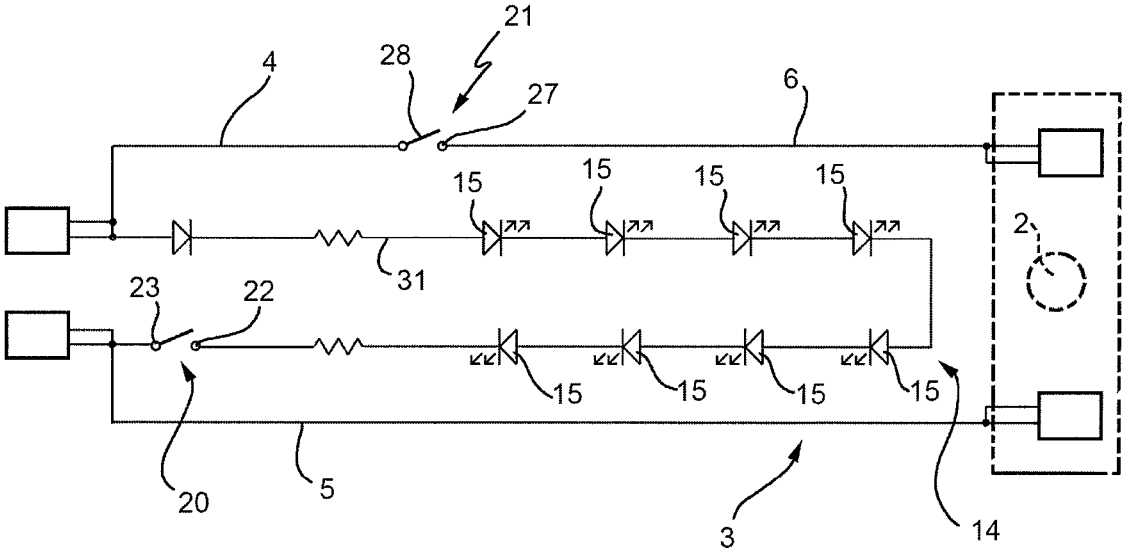
FIG. 2 shows a simple wiring diagram of the lighting harness element in FIG. 1.

With reference to figures from 1 to 6, numeral 1 indicates a lighting control switch harness (FIG. 3) for the gas taps of burners 2 (of which only one is shown in FIG. 2) of a cooking range (known and not shown for the sake of simplicity).

The switch harness 1 comprises a plurality of elements 3 connected to one another mechanically in series and electrically in parallel, according to a feature of the invention, by only three electric conductor wires, indicated by numerals 4, 5 and 6, respectively.

Figure 1:
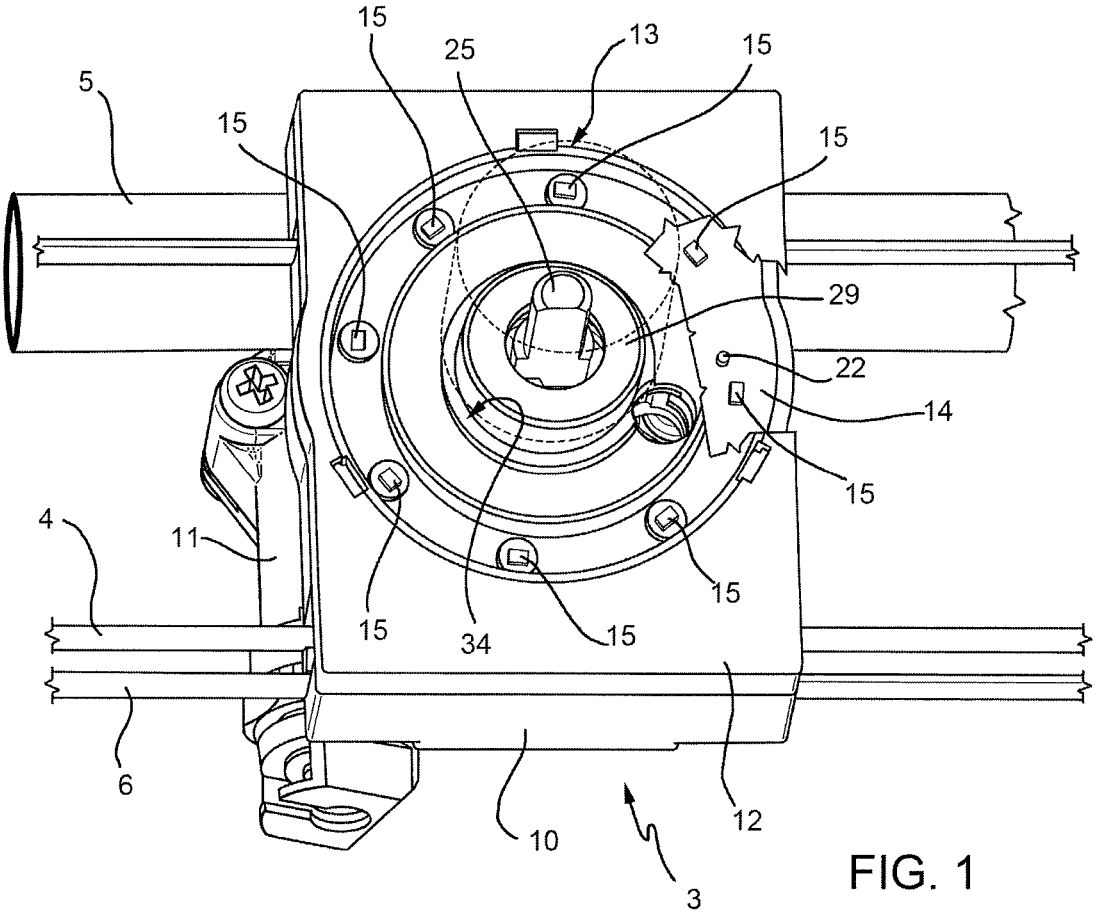
FIG. 1 shows a three-quarters, axonometric view of an element of the switch harness according to the invention fitted on a gas tap, underneath thereto.

Each element 3 comprises a body 10, couplable in use to a respective gas tap 11 and closed by a cover 12 (FIG. 1) at least partially pervious to light, e.g. because it is provided with at least one window 13, ring-shaped in the non-limitative example.

A printed circuit 14, carrying a plurality of LEDs 15 arranged in a circle at the ring-shaped window 13, about the gas tap 11, is arranged in the body 10 immediately under the cover 12; it is apparent that any other position of the LEDs 15 or of other light sources according to a different shape and position of the window 13 is possible.

Figure 6:
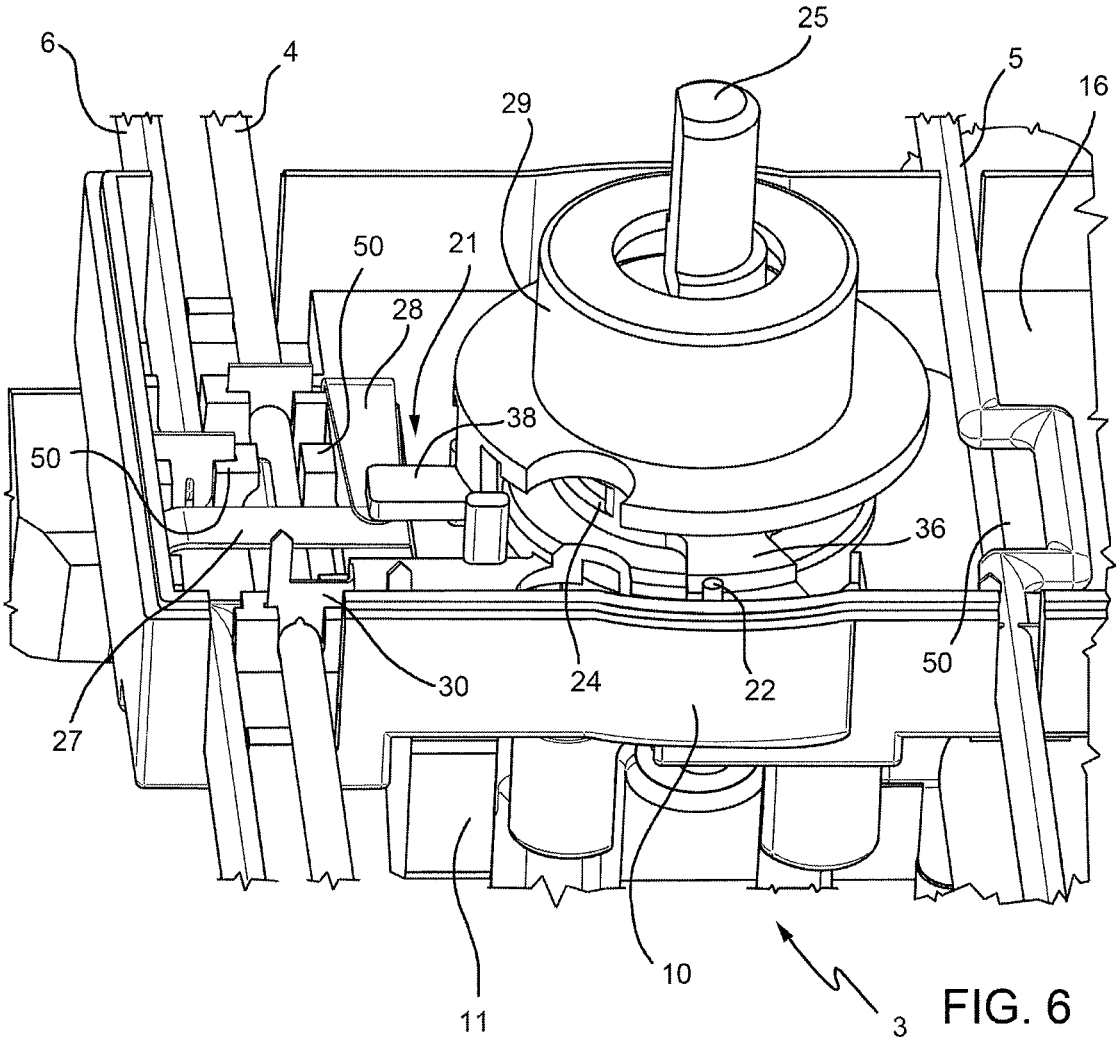
FIGS. 4, 5 and 6 show the lighting harness element in FIG. 1 with parts gradually removed.
Figure 4:
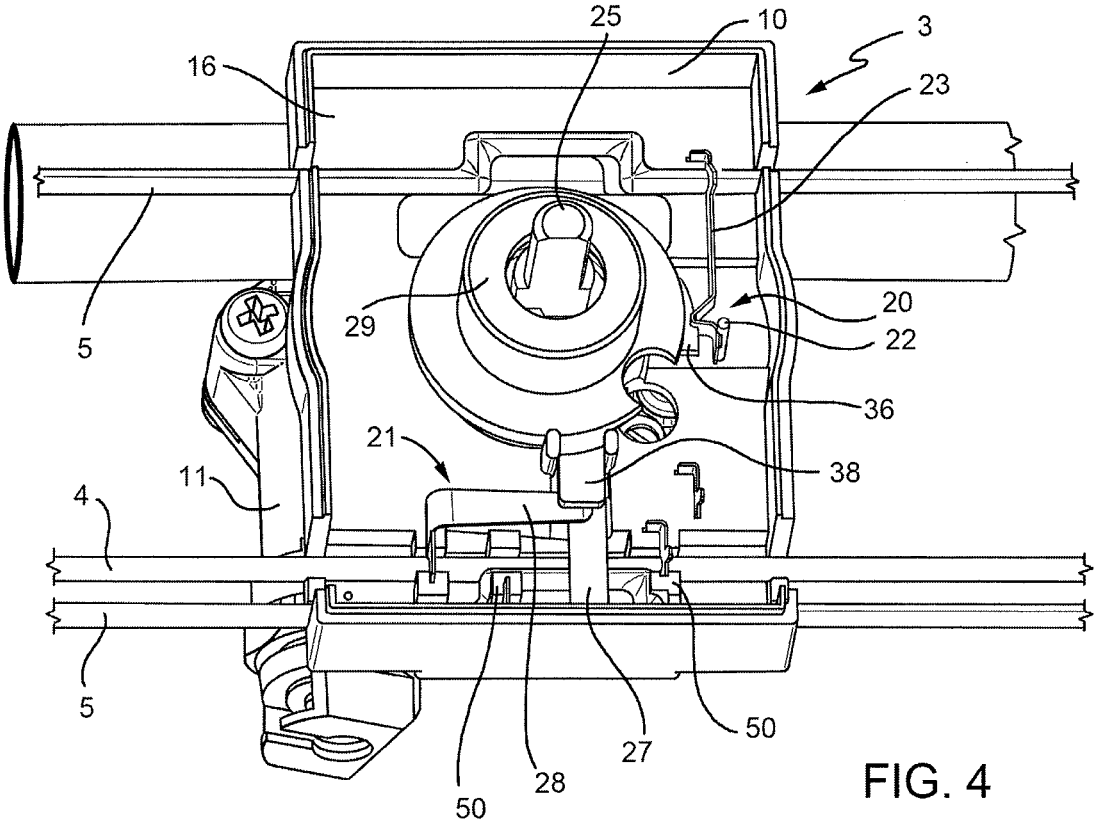
Figure 5:
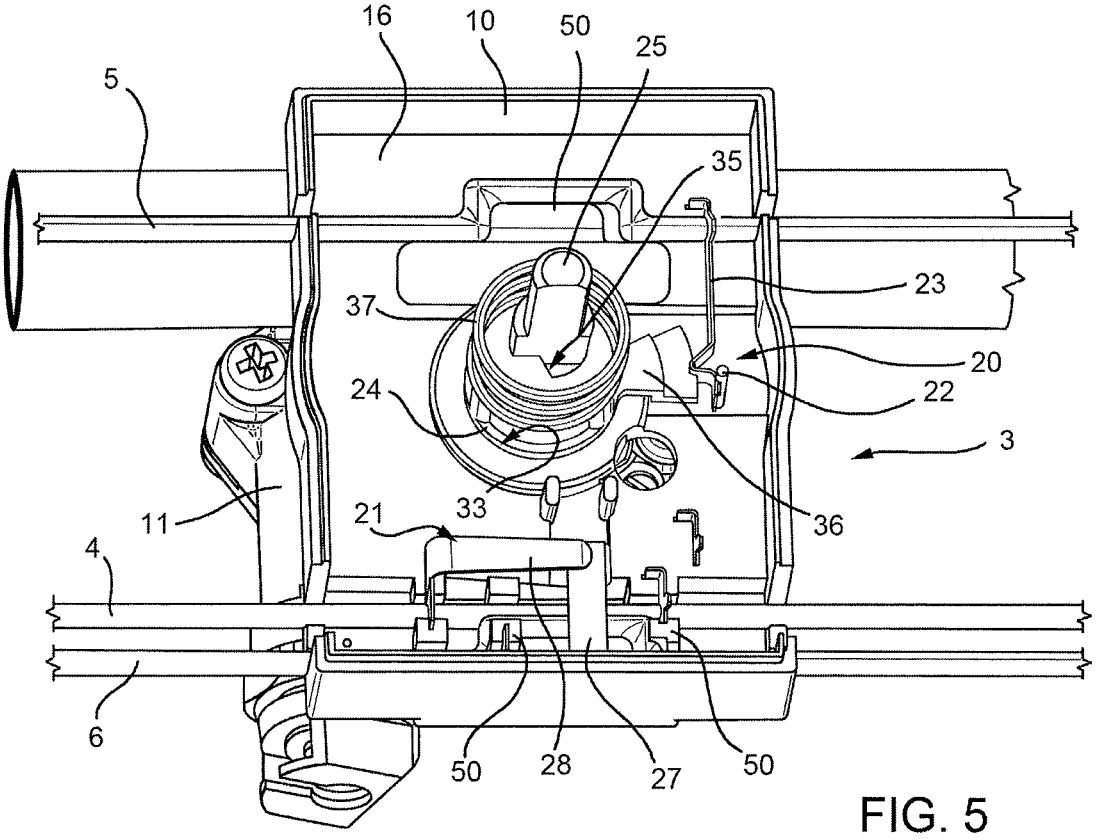

The body 10 is cup-shaped and delimited, on the side opposite to the cover 12, by a bottom wall 16 (FIGS. 4-6) facing the cover 12 with the interposition of the printed circuit 14. A first switch 20 and a second switch 21 are accommodated as integral part of each element 3 in the body 10 arranged under the printed circuit 14, between the latter and the bottom wall 16.

The switch 20 comprises at least one fixed contact 22 connected to the printed circuit 14, a mobile contact 23 and first means 24 carried by the body 10 so as to be in use operatively couplable to a mobile stem 25 (known) of the gas tap 11 for turning integrally with the same and consequently taking the mobile contact 23 towards the at least one fixed contact 22.

The switch 21 comprises in turn a fixed contact 27, a mobile contact 28 and second means 29 (FIGS. 4 and 6) carried by the body 10 so as to be in use operatively couplable to the mobile stem 25 of the gas tap 11 to translate parallelly to the same and consequently take the mobile contact 28 towards the fixed contact 27.

According to the invention, the elements 3 are mechanically and electrically connected to one another only by means of the three wires 4, 5 and 6, passing through the body 10 of the various elements 3. In particular, the wire 4 is connected to a first contact 28 of the switch 21 of each element 3, in the non-limitative case in point to the mobile contact 28, while wire 5 is connected to the mobile contact 23 of the switch 20 of each element 3, and wire 6 is connected to the fixed contact 27 of the switch 21 of each element 3. Furthermore, the wire 4 is also electrically connected in a permanent manner to the printed circuit 14 of each element 3 by means of a metallic contact terminal 30 (FIG. 6) carried by the body 10.

On the printed circuit 14 an electric power supply circuit 31 for the LEDs 15, substantially of known type, is obtained in known manner, the electric power supply of which is controlled by the switch 20.

The bottom wall 16 is provided with a hole 33 (FIG. 5) designed to couple in use with the gas tap 11, e.g. snappingly, from the side of the mobile stem 25, so as to be thoroughly crossed in use by the mobile stem 25 itself, which further also crosses the cover 12 facing the bottom wall 16 and the interposed printed circuit 14 by virtue of the conformation of the printed circuit 14 and the presence of a second hole 34 obtained passing through the cover 12, coaxial with the hole 33.

The means 24 consist of a ring idly guided into the first hole 33 and equipped radially on the inside thereof with (known) angular fastening means 35 to the mobile stem 25 and radially on the outside thereof with an overhanging radial appendix 36 which extends into the body 10 and cooperates with the mobile contact 23, which consists of an elastic metal blade carried by the bottom wall 16 of the body 10 arranged on edge, i.e. with the laying plane thereof perpendicular to the wall 16 and electrically connected to wire 5.

The means 29 consist of a cup-shaped bush mounted coaxially with the ring 24, with the interposition of a helical spring 37 (visible in FIG. 5 where the bush 29 is removed), which bush 29 is thoroughly and slidingly guided into the second hole 34 and designed to be thoroughly crossed, in use, by the mobile stem 25.

In particular, the bush 29 is mounted overhangingly protruding from the cover 12 (FIG. 1) and is provided with a radial arm 38 (FIG. 4, 6) cooperating with the mobile contact 28 and arranged angularly offset with respect to the radial appendix 36 of the ring 24. The mobile contact 28 consists of an elastic blade overhangingly supported flat by the bottom wall 16, i.e. with its laying plane parallel to the latter, and electrically connected to the wire 4.

In the illustrated example, the fixed contact of the switch 20 consists of a pin 22 carried by the printed circuit 14 perpendicularly to the bottom wall 16 of the body and electrically connected to the printed circuit (14) itself; the latter, as previously mentioned, is further electrically connected to the wire 4 by means of the contact terminal 30.

The body 10 is further internally provided with fixing means 50 for the wires 4, 5, 6, constituted by compression cocking elements which, working in cooperation with the fixed and mobile contact terminals of the switches 20,21, prevent the wires themselves from axially sliding through the body 10 of each element 3, thus maintaining the respective position of the elements 3 along the entire extension of the switch harness 1.

In use, the switch harness 1 is mounted on the cooking range of the electric household appliance, by fitting each element 3 integrally to a gas tap 11.

In order to light a burner, the user must take a control knob of the tap 11 (known and illustrated by a dashed line in FIG. 1), to then turn it, by holding it pressed, to a position corresponding to the required gas flow: this movement causes a translation and subsequent rotation of the stem 25. The pressure on the knob (not shown) is also transmitted to the bush 29, underneath it, making the switch 21 close and consequently producing in known manner the power supplying of the lighting circuit (known and not shown) of the burners 2. At the same time, the rotation of the stem 25 produces the rotation of the ring 24 with consequent delivery towards the burner 2, by the gas tap 11, of a flow of gas fuel, e.g. methane, and simultaneously the closing of the switch 20, with consequent electric power supply of the circuit 31 carried by the printed circuit 14 and simultaneous lighting of all LEDs 15. Through the window 13 a ring-shaped lighting is thus created about the knob (not shown) of the gas tap 11, which remains actuated also when the knob is released, if it is not returned to the closed tap position, while the switch 21, on the other hand, opens by elastic return of the blade 28, making the generation of sparks on the burner 2 cease.

When the gas tap 11 is closed by turning the knob in the other sense, the switch 20 is opened turning the light sources off, in the case in point the LEDs 15. In this manner, when the gas is delivered to the burner 2, the knob of the corresponding gas tap 11 is lit, warning the user that the gas is delivered into the atmosphere.

It is apparent that the switch harness 1 can be adapted with changes obvious for a person skilled in the art so as to let the LEDs 15 light up gradually as the stem 25 is turned instead of making them light up all at the same time. For this purpose, it would be sufficient, for example, to replace the two-contact switch 20, with a multiple contact switch, in which the mobile contact is a brush which progressively reaches a plurality of fixed contact, appropriately connected to one another.

The invention claimed is:

1. A lighting control switch harness for burners of a cooking range comprising a plurality of elements connected to one another and each comprising: a body couplable in use to a respective gas tap and closed by a cover at least partially pervious to light; a printed circuit underneath the cover and carrying one or more light sources, a first switch accommodated within the body and comprising at least one fixed contact connected to the printed circuit, a mobile contact and first means carried by the body so as to be operatively couplable in use to a mobile stem of the gas tap for integrally rotating therewith and then taking the mobile contact towards the at least one fixed contact; and a second switch accommodated within the body and comprising a fixed contact, a mobile contact and second means carried by the body so as to be in use operatively couplable to the mobile stem of the gas tap for translating parallelly thereto and then taking the mobile contact towards the fixed contact; said elements being mechanically and electrically connected to one another only by means of three wires passing through the body of the various elements, a first wire being connected to a first contact of the second switch of each element, a second wire being connected to the mobile contact of the first switch of each element, and a third wire being connected to a second contact of the second switch of each element.

2. A harness according to claim 1, characterized in that said printed circuit is further electrically connected to said first wire.

3. A harness according to claim 1, characterized in that said body is cup-shaped and has a bottom wall provided with a first hole designed to couple with said gas tap, from the side of the mobile stem of the latter so as to be thoroughly crossed in use by the mobile stem; said cover facing the bottom wall with the interposition of said printed circuit and being provided with at least one window for said light sources and with a second hole coaxial with the first for the mobile stem passing in use.

4. A harness according to claim 3, characterized in that said first means consists of a ring idly guided into the first hole and equipped radially on the inside thereof with angular fastening means to the mobile stem and radially on the outside thereof with an overhanging radial appendix which extends into the body and cooperates with the mobile contact, which consists of an elastic metal plate carried by the bottom wall of the body arranged perpendicular to the same and electrically connected to said second wire.

5. A harness according to claim 4, characterized in that said second means consist of a cup-shaped bush mounted coaxially with the ring, with the interposition of a helical spring, which bush is thoroughly and slidingly guided into the second hole and designed to be thoroughly crossed, in use, by the mobile stem.

6. A harness according to claim 5, characterized in that the bush is mounted overhangingly protruding from the cover and is provided with a radial arm cooperating with the mobile contact and arranged angularly offset with respect to the radial appendix of the ring; the mobile contact consisting of an elastic blade overhangingly supported by the bottom wall, parallelly to the same and electrically connected to said first wire.

7. A harness according to claim 2, characterized in that the fixed contact of the first switch consists of a pin carried by the printed circuit perpendicularly to the bottom wall of the body and electrically connected to the printed circuit itself; the latter being further electrically connected to the first wire by means of a metal contact terminal carried by the body.

8. A harness according to claim 1, characterized in that said body is internally provided with fixing means for said wires.

9. A harness according to claim 1, characterized in that:
one or more of the light sources are LEDs.

10. A harness according to claim 1, characterized in that:
the first means is a separate component from the second means and the harness is configured such the first means is movable relative to the second means.

11. A lighting control switch harness for burners of a cooking range comprising a plurality of elements connected to one another and each comprising:
a body couplable in use to a respective gas tap and closed by a cover at least partially pervious to light;
a printed circuit underneath the cover and carrying one or more light sources;
a first switch accommodated within the body and comprising at least one fixed contact connected to the printed circuit;
a first mobile contact and a ring carried by the body configured to be operatively couplable in use to a mobile stem of the gas tap for integrally rotating therewith and then taking the mobile contact towards the at least one fixed contact; and
a second switch accommodated within the body and including:
a fixed contact;
a mobile contact; and
a bush carried by the body and configured so as to be in use operatively couplable to the mobile stem of the gas tap and translatable parallelly thereto and then to take the mobile contact towards the fixed contact, wherein
the elements are mechanically and electrically connected to one another only by three wires passing through the body of the various elements, a first wire being connected to a first contact of the second switch of each element, a second wire being connected to the mobile contact of the first switch of each element, and a third wire being connected to a second contact of the second switch of each element.

12. A harness according to claim 1, wherein the printed circuit is further electrically connected to said first wire.

13. A harness according to claim 1, wherein the body is cup-shaped and has a bottom wall provided with a first hole designed to couple with said gas tap, from the side of the mobile stem of the latter so as to be thoroughly crossed in use by the mobile stem, and wherein the cover faces the bottom wall with the interposition of said printed circuit and is provided with at least one window for said light sources and with a second hole coaxial with the first for the mobile stem passing in use.

14. A harness according to claim 12, wherein the fixed contact of the first switch consists of a pin carried by the printed circuit perpendicularly to the bottom wall of the body and electrically connected to the printed circuit itself, the latter being further electrically connected to the first wire by a metal contact terminal carried by the body.

15. A harness according to claim 11, wherein said body is internally provided with fixing means for said wires.

16. A harness according to claim 11, wherein:
the one or more of the light sources are LEDs.

17. A harness according to claim 11, wherein:
the harness is configured such the ring is movable relative to the bush.

18. A harness according to claim 1, wherein:
the harness further includes a control knob; and
the harness is configured such that the control knob is turned by holding it pressed, which pressure resulting from the pressed holding is transmitted to the second means, making the second switch close.

19. A harness according to claim 11, wherein:
the harness further includes a control knob; and
the harness is configured such that the control knob is turned by holding it pressed, which pressure resulting from the pressed holding is transmitted to the bush, making the second switch close.

20. A harness according to claim 1, wherein the first wire, the second wire and the third wire extend from a first element of the plurality of elements to a second element of the plurality of elements.

21. A harness according to claim 11, wherein the first wire, the second wire and the third wire extend from a first element of the plurality of elements to a second element of the plurality of elements.

* * * * *